US005455612A

United States Patent [19]

Ikeda et al.

[11] Patent Number: 5,455,612

[45] Date of Patent: Oct. 3, 1995

[54] LIQUID JET RECORDING HEAD

[75] Inventors: Masami Ikeda, Machida; Hiroto Matsuda, Ebina; Hirokazu Komuro, Hiratsuka; Hiroto Takahashi, Hiratsuka; Makoto Shibata, Hiratsuka; Hisanori Tsuda, Atsugi, all of Japan

[73] Assignee: Canon Kabushiki Kaisha, Tokyo, Japan

[21] Appl. No.: 299,798

[22] Filed: Sep. 1, 1994

Related U.S. Application Data

[63] Continuation of Ser. No. 25,739, Mar. 3, 1993, abandoned, which is a continuation of Ser. No. 727,283, Jul. 5, 1991, abandoned, which is a continuation of Ser. No. 508,489, Apr. 11, 1990, abandoned, which is a continuation of Ser. No. 341,294, Apr. 21, 1989, abandoned, which is a continuation of Ser. No. 29,370, Mar. 24, 1987, abandoned, which is a continuation of Ser. No. 684,114, Dec. 20, 1984, abandoned.

[30] Foreign Application Priority Data

Dec. 26, 1983 [JP] Japan ..... 58-249079
Jan. 31, 1984 [JP] Japan ..... 59-14518

[51] Int. Cl.[6] ..... B41J 2/05
[52] U.S. Cl. ..... 347/64
[58] Field of Search ..... 347/64, 63, 56

[56] References Cited

U.S. PATENT DOCUMENTS 4,335,389 6/1982 Shirato et al. ..... 347/64
4,410,899 10/1983 Haruta et al. ..... 347/56
4,429,321 1/1984 Matsumoto ..... 347/59
4,450,457 5/1984 Miyachi ..... 347/64
4,567,493 1/1986 Ikeda et al. ..... 347/64
4,577,202 3/1986 Hara ..... 347/64

FOREIGN PATENT DOCUMENTS 3011919 10/1980 Germany ..... B41J 3/04
3231431 3/1983 Germany ..... B41J 3/04
3414937 10/1984 Germany ..... B41J 3/04
2007162 10/1982 United Kingdom ..... B41J 3/04

*Primary Examiner*—Joseph W. Hartary
*Attorney, Agent, or Firm*—Fitzpatrick, Gella, Harper & Scinto

[57] ABSTRACT

A liquid jet recording head comprises a substrate comprising a support, a resistive heater layer, electrodes electrically connected with the resistive heater layer, a portion of the resistive heater layer located between the electrodes being an electrothermal transducer, and an upper layer comprising a first protective layer comprising an inorganic insulating material, a second protective layer comprising an inorganic material, and a third protective layer comprising an organic material, wherein and the second protective layer and the third protective layer overlap each other in the vicinity of a portion where heat is generated by the electrothermal transducer and the overlapping width of the second protective layer and the third protective layer ranges from 10 μm to 500 μm. In another embodiment, the second protective layer extends along plural liquid flow paths for substantially less than the length thereof in a continuous strip that covers adjacent transducers.

48 Claims, 7 Drawing Sheets

LIQUID JET RECORDING HEAD

This application is a continuation of application Ser. No. 08/025,739 filed Mar. 3, 1993, now abandoned, which is a continuation of application Ser. No. 07/727,283 filed Jul. 5, 1991, now abandoned, which in turn is a continuation of application Ser. No. 07/508,489 filed Apr. 11, 1990, now abandoned, which in turn is a continuation of application Ser. No. 07/341,294 filed Apr. 21, 1989, now abandoned, which in turn is a continuation of application Ser. No. 07/029,370 filed Mar. 24, 1987, now abandoned, which in turn is a continuation of application Ser. No. 06/684,114 filed Dec. 20, 1984, now abandoned.

BACKGROUND OF THE INVENTION

1. Field of the Invention

This invention relates to a liquid jet recording head which ejects liquid to produce flying liquid droplets to record.

2. Description of the Prior Art

Ink jet recording techniques (liquid jet recording methods) have recently attracted attention since they generate negligible noise upon recording, enable high speed recording and can record on plain paper without any special fixation treatment.

Among such techniques, for example, the liquid jet recording method disclosed in Japanese Patent Laid-open No. 51837/1979 and German Patent Laid-open (DOLS)No. 2843064 is different from other liquid jet recording method in that heat energy is applied to liquid to produce a driving force for ejecting liquid droplets.

That is, the above-mentioned recording method comprises applying heat energy to a liquid to cause an abrupt increase in the volume of the liquid, ejecting the liquid from the orifice at the front of the recording head to form flying liquid droplets and attaching the droplets to a record receiving member to effect recording.

In particular, the liquid jet recording method disclosed in DOLS 2843064 can be not only effectively suitable for so-called "drop-on-demand" recording methods, but also enables to realization of a high density multi-orifice recording head of a full-line type, and therefore, images of high resolution and high quality can be produced at a high speed.

The recording head portion of an apparatus used for the above-mentioned recording method comprises a liquid ejecting portion constituted of an orifice for ejecting liquid and a liquid flow path containing, as a part of the construction, a heat actuating portion communicated with the orifice and applying heat energy to the liquid for ejecting liquid droplets, and an electrothermal transducer for generating heat energy.

The electrothermal transducer is provided with a pair of electrodes and a resistive heater layer connected to the electrodes and having a region generating heat (heat generating portion) between the electrodes.

A typical embodiment of the structure of such a liquid jet recording head is shown in FIGS. 1A, 1B, 1C and 1D.

FIG. 1A is a partial front view of the liquid jet recording head viewed from the orifice side, and FIGS. 1B, 1C and 1D are partial cross sectional views of different configurations taken along the dot and dash line XY of FIG. 1A.

Recording head 100 is constituted of orifice 104 and liquid ejecting portion 105 formed by bonding the surface of substrate 102 provided with electrothermal transducer 101 to a grooved plate 103 having a predetermined number of grooves having a predetermined width and depth at a predetermined line density such that the grooved plate covers the substrate. In FIG. 1, the recording head has a plurality of orifices 104, but the present invention is not limited to such an embodiment and a recording head having a single orifice is also within the scope of the present invention.

Liquid ejecting portion 105 has orifice 104 ejecting liquid at the end and heat actuating portion 106 where thermal energy generated by electrothermal transducer 101 is applied to liquid to form a bubble and where an abrupt state change due to expansion and shrinkage of the volume occurs.

Heat actuating portion 106 is located above heat generating portion 107 of electrothermal transducer 101, and a heat actuating surface 108 where heat generating portion 107 contacts the liquid is the bottom surface of the heat actuating portion 106.

Heat generating portion 107 is constituted of lower layer 109 provided on support 115, resistive heater layer 110 provided on lower layer 109, and first protective layer 111 provided on resistive heater layer 110. Resistive heater layer 110 is provided with electrodes 113 and 114 for flowing electric current to the layer 110 to generate heat. Electrode 113 is an electrode common to heat generating portions of liquid ejecting portions, and electrode 114 is a selection electrode for selecting the heat generating portion of each liquid ejecting portion to generate heat and is provided along the liquid flow path of each liquid ejecting portion.

First protective layer 111 serves to chemically and physically protect resistive heater layer 110 from the liquid at the heat generating portion 107 by isolating resistive heater layer 110 from the liquid in the liquid flow path at liquid ejecting portion 105, and also prevents short-circuits between electrodes 113 and 114 through the liquid. Thus, first protective layer 111 serves to protect resistive heater layer 110. First protective layer 111 also serves to prevent electric leakage between adjacent electrodes. In particular, it is important to prevent electric leakage between selection electrodes and electrolytic corrosion of electrodes caused by electric current flowing in an electrode resulting from contact of an electrode under the liquid flow path with the liquid, which may happen. Therefore, such a first protective layer 111 having a protective function is provided on at least an electrode which is disposed under a liquid flow path.

The upper layer including the first protective layer is required to have various properties depending on the position to be disposed. That is, for example the following characteristics are required at heat generating portion 107:

1) heat resistance, 2) liquid resistance, 3) liquid penetration prevention, 4) thermal conductivity, 5) oxidation prevention, 6) insulation, and 7) breakage prevention.

At portions other than heat generating portion 107, sufficiently high liquid penetration preventing property, liquid resistance and breakage preventing property are required, while resistance to stringent thermal conditions is not required.

However, at present there is not any material for constituting the upper layer capable of sufficiently satisfying all the characteristics 1)–7) as mentioned above. It is the present status that some of the conditions 1)–7) are not severely requested. For example, at heat generating portion 107, materials are selected by giving priority to conditions 1), 4) and 5) while, at portions other than heat generating portion 107, for example, at electrode portions, materials are selected by giving priority to conditions 2), 3) and 7), and the materials thus selected are disposed on the corresponding region surfaces to form the upper layer.

Apart from the above, in the case of a liquid jet recording head of a multi-orifice type, since a number of fine electrothermal transducers are formed on the substrate simultaneously, formation of each layer of the substrate and removal of a part of the formed layer are repeated, and as a result, the surface on which each layer in the upper layer is to be formed becomes a fine uneven surface having step edge portions, and therefore, the step coverage property of the layers in the upper layer at the step edge portions becomes important. In other words, when the step coverage property at the step edge portions is poor, penetration of the liquid occurs at the portions and causes electrolytic corrosion or dielectric breakdown. Further, the formed upper layer can suffer from the formation of defects upon fabrication with a considerable probability, and penetration of liquid through the defective portions results in shortening the life of the electrothermal transducer to a great extent.

In view of the foregoing, it is required that the upper layer has a good step coverage property at the step edge, defects such as pinholes and the like occur in the formed layer with only a low probability and even if the detects are formed, the number of defects is negligible.

In order to satisfy those requisites, heretofore the upper layer has been produced by laminating the first protective layer composed of an inorganic insulating material and the third protective layer composed of an organic material, or the first protective layer is constituted of two layers, that is, an under layer composed of an inorganic insulting material and an above layer composed of an inorganic material of high toughness, relatively excellent mechanical strength and having adhesion and cohesion to the first protective layer and the third protective layer, such as metals and the like, or the second protective layer composed of an inorganic material such as metals and the like overlies the third protective layer.

Though the third protective layer composed of an organic material is excellent in coating property, the heat resistance is poor so that the third protective layer can not be provided on the resistive heater layer at the heat generating portion. On the contrary, the second protective layer composed of an inorganic material such as metals is provided over the whole surface as an outermost surface layer of the substrate, or only on the resistive heater layer of the heat generating portion. When the second protective layer is provided in such a manner as the latter, but the third protective layer 112 does not overlap the second protective layer 116 as shown in FIG. 1B, there is only the first protective layer at portion b and therefore, sufficient protection can not be provided. Further, potential is locally concentrated to that portion and eventually, the electrode layer begins to dissolve; that is, corrosion resistance deteriorates. Even if the third protective layer overlaps the second protective layer, as far as the overlapping width is small as illustrated in FIGS. 1C and 1D, the liquid penetrates and potential is concentrated when the liquid soaking time is long, and therefore, dissolution of the electrode portion occurs. On the contrary, when the overlapping width is too large, the following problems occur. As shown in FIG. 1E, when, in the vicinity of the heat generating portion, second protective layer 116 composed of an inorganic material such as metals and the like is provided below third protective layer 112 composed of an organic material and on the first protective layer 111, the probability of occurrence of short between second protective layer 116 and electrode 113 or 114 disadvantageously increases and the yield of the products is extremely decreased. As shown in FIG. 1F, when opposite to FIG. 1E, the upper layer in the vicinity of the heat generating portion are laminated such that third protective layer 112 overlies first protective layer 111 and second protective layer 116 overlies the third protective layer, the liquid penetrates from the liquid flow path and exfoliation of the organic material layer (the protective layer) proceeds due to the stress of the inorganic material layer (the second protective layer).

On the other hand, the liquid is vaporized by heating at heat actuating portion 106, but the vapor is immediately cooled to condense since it is a subcooled boiling and the heating time is short. Therefore, bubble formation and condensation are repeated at a high frequency of several thousand times per sec. in the vicinity of the heat actuating surface, and the pressure change caused here can break the substrate (cavitation corrosion).

Since printed letters or signs of high image quality high density have been recently demanded, and there are required more precise processing of minute portions such as electrodes, resistive heater layers, accompanying protective layers and the like.

SUMMARY OF THE INVENTION

An object of the present invention is to provide a liquid jet recording head free from the above-mentioned drawbacks.

Another object of the present invention is to provide a liquid jet recording head which has a general durability upon the frequent repeated use and the long time continuous use and can stably maintain the excellent liquid droplet forming characteristics as at the beginning for a long period of time.

A further object of the present invention is to provide a liquid jet recording head which can be fabricated with a high reliability.

Still another object of the present invention is to provide a liquid jet recording head which can be fabricated in a high yield even when it is of a multi-orifice type.

According to one aspect of the present invention, there is provided a liquid jet recording head comprising: a substrate comprising a support, a resistive heater layer, electrodes electrically connected with the resistive heater layer, a portion of the resistive heater layer located between the electrodes being an electrothermal transducer, and an upper layer comprising a first protective layer comprising an inorganic insulating material, a second protective layer comprising an inorganic material, and a third protective layer comprising an organic material; a liquid flow path provided on the substrate and corresponding to the electrothermal transducer; the upper layer comprising a region where the first protective layer overlies the electrothermal transducer and the second protective layer overlies said first protective layer, and the other region where the first protective layer overlies portions corresponding to the electrodes under the liquid flow path, and the third protective layer overlies the first protective layer, provided that the second protective layer extends from the electrothermal transducer portion to the portions corresponding to the electrodes and the second protective layer and the third protective layer overlap each other in the vicinity of a portion where heat is generated by the electrothermal transducer, characterized in that the overlapping width of the second protective layer and the third protective layer ranges from 10 μm to 500 μm.

According to another aspect of the present invention, there is provided a liquid jet recording head comprising: a substrate comprising a support, a resistive heater layer, electrodes electrically connected with the resistive heater layer, a portion of the resistive heater layer located between the electrodes being an electrothermal transducer, and an upper layer comprising a first protective layer comprising an inorganic insulating material, and a second protective layer comprising an inorganic material, a liquid flow path provided on the substrate and corresponding to the electrothermal transducer; the first protective layer and the second protective layer being successively formed at least on the electrothermal transducer generating heat, characterized in that the second protective layer is in a form of a strip which covers adjacent electrothermal transducers.

BRIEF DESCRIPTION OF THE DRAWINGS

FIG. 1A shows schematically a partial front view and each FIG. 1B, C, D, E, F, G and H is a partial cross-sectional view taken along a dot and dash line XY of different configurations represented by FIG. 1A.

FIG. 4A shows schematically the partial front view.

DESCRIPTION OF THE PREFERRED EMBODIMENTS

Figure 1A:
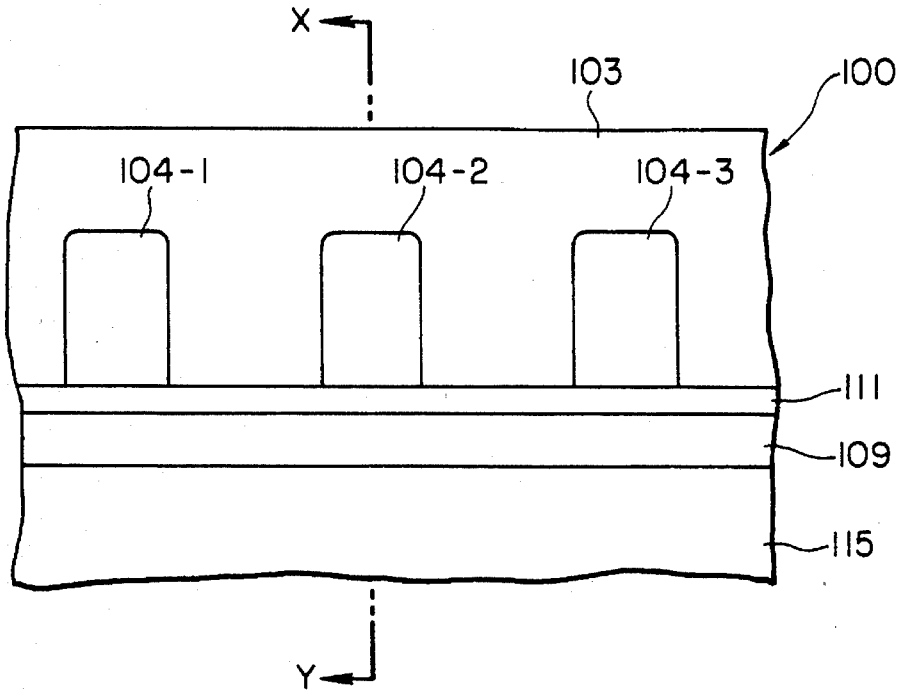
FIG. 1A PRIOR ART
FIG. 1A, B, C, D, E and F refer to the constitution of a conventional liquid jet recording head and FIG. 1G and H refer to the constitution of a liquid jet recording head according to the present invention.
Figure 1B:
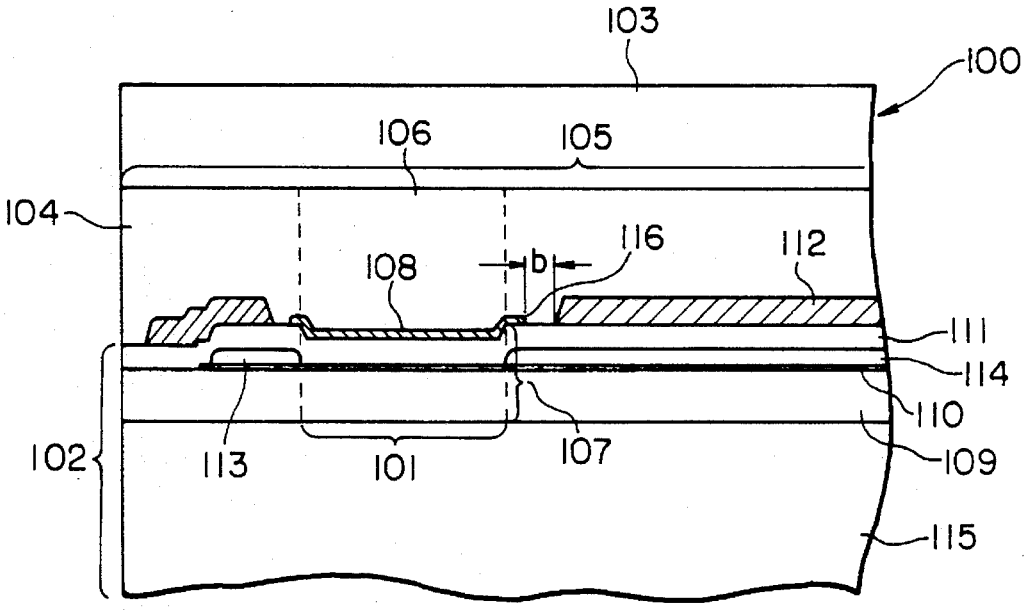
FIG. 1B PRIOR ART
FIG. 1B shows an embodiment where a second protective layer does not overlap a third protective layer.
Figure 1C:
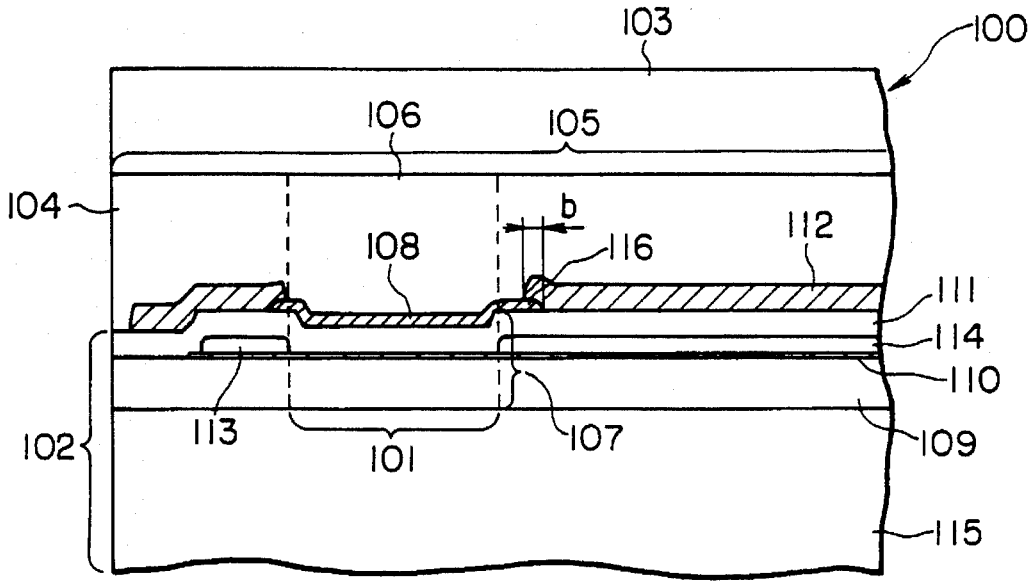
FIG. 1C PRIOR ART
FIG. 1C, E and G show an embodiment where a third protective layer overlaps a second protective layer.
Figure 1D:
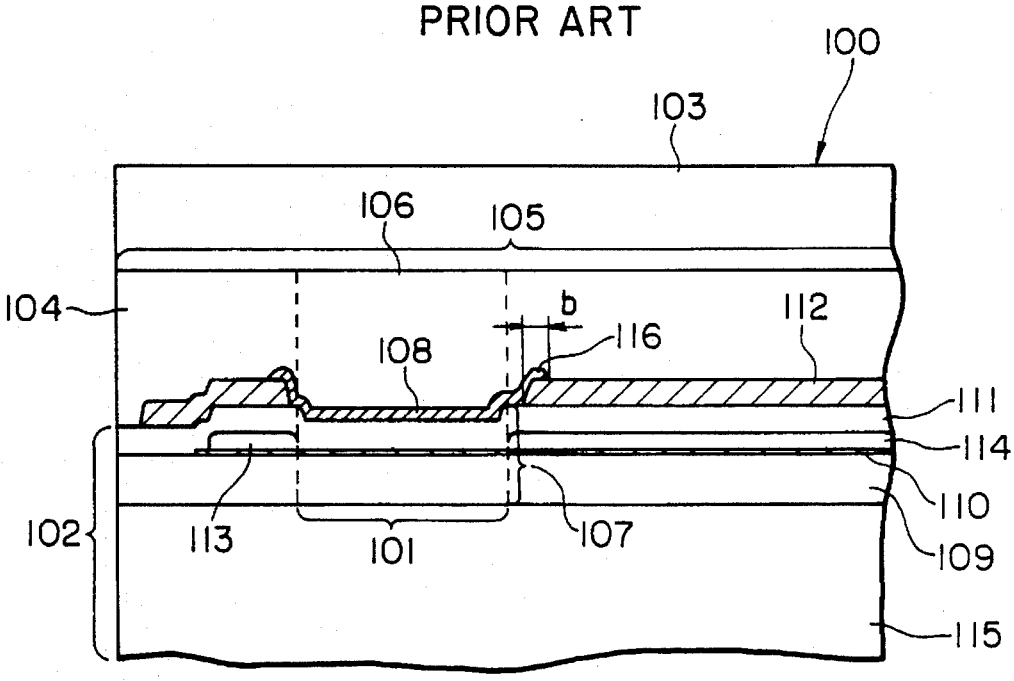
FIG. 1D PRIOR ART
FIG. 1D, F and H show an embodiment where a second protective layer overlaps a third protective layer.
Figure 1E:
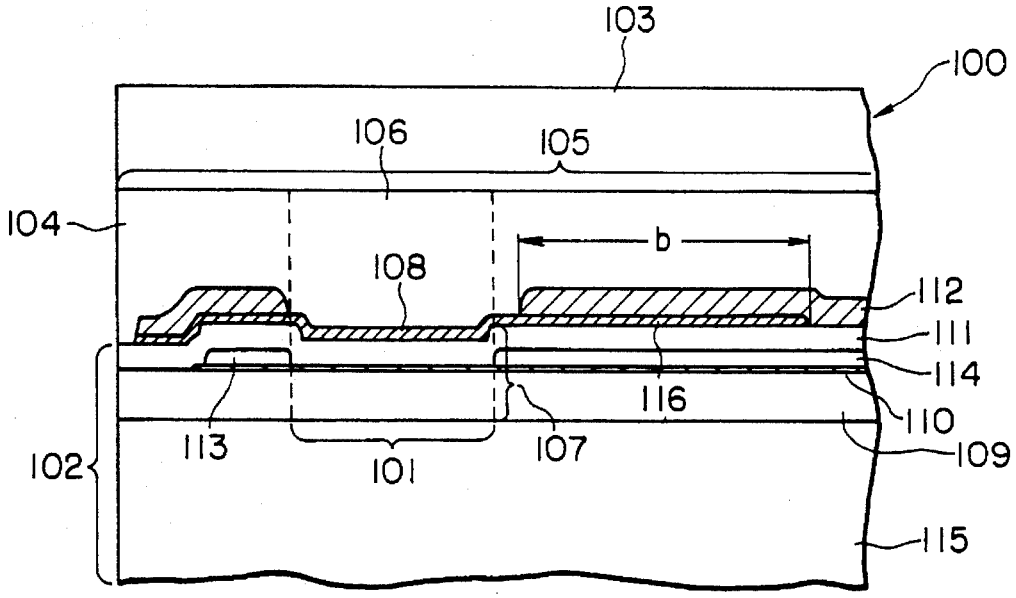
FIG. 1E PRIOR ART
Figure 1F:
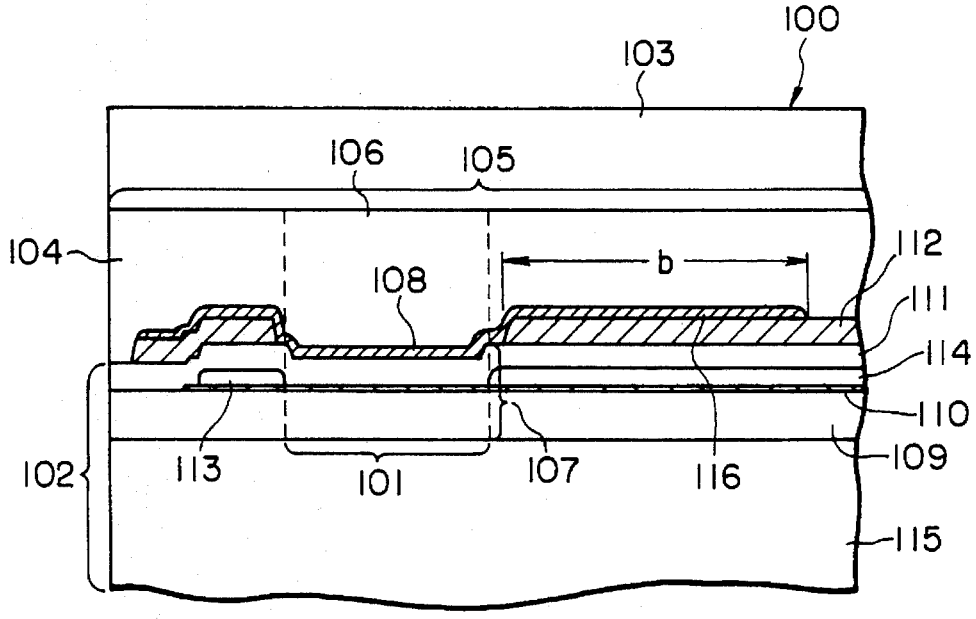
FIG. 1F PRIOR ART
Figure 1G:
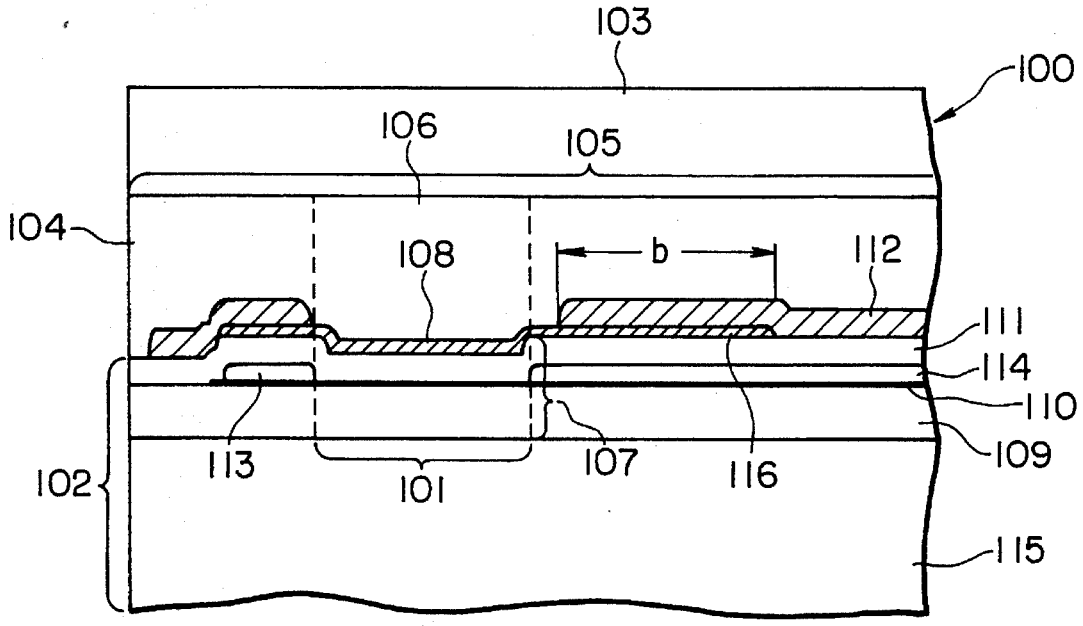
Figure 1H:
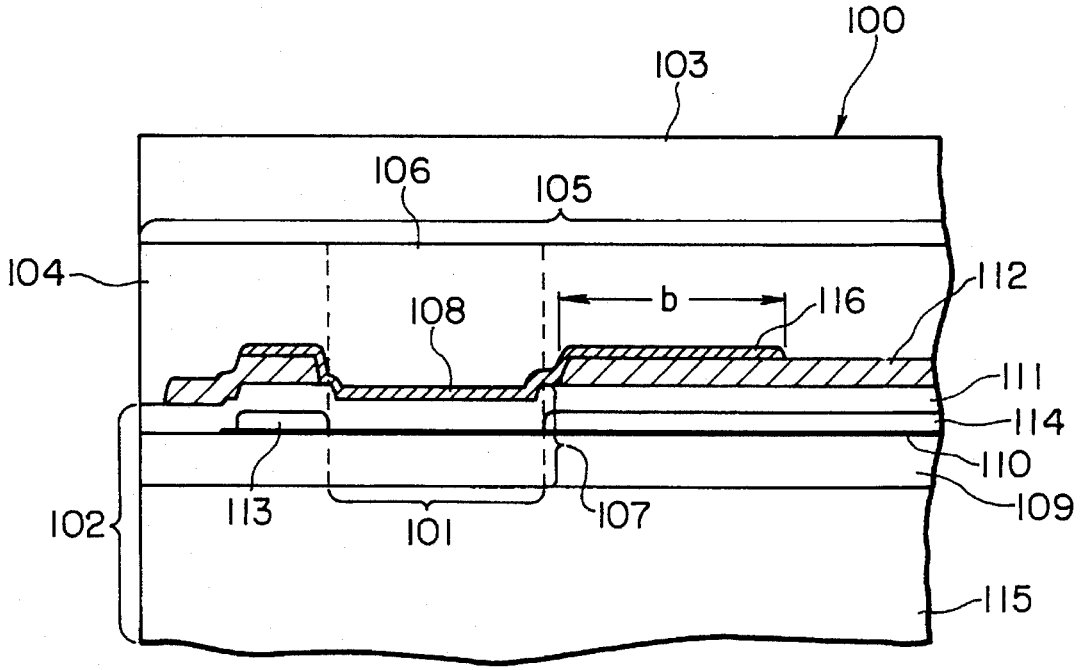

Referring to FIG. 1G and H, a first protective layer 111 is composed of inorganic insulating material, for example, inorganic oxides such as $SiO_2$ and the like and inorganic nitrides such as $Si_3N_4$ and the like. The second protective layer 116 has toughness and a relatively excellent mechanical strength. Further, the second layer is preferably composed of a material having adhesion and cohesion to the first protective layer, for example, a metal material such as Ta and the like where the first protective layer is composed of $SiO_2$. As described above., when the second protective layer is composed of an inorganic material such as metals and the like which is relatively tough and has a mechanical strength, the shock due to cavitation caused upon jetting liquid can be sufficiently absorbed especially at the heat actuating surface 108, and the life of the electrothermal transducer 101 can be extended to a great extent.

As materials constituting the first protective layer 111, there are preferably used inorganic insulating materials relatively excellent in thermal conductivity and heat resistance, for example, inorganic oxides such as $SiO_2$ and the like, transition metal oxides such as titanium oxide, vanadium oxide, niobium oxide, molybdenum oxide, tantalum oxide, tungsten oxide, chromium oxide, zirconium oxide, hafnium oxide, lanthanum oxide, yttrium oxide, manganese oxide and the like, metal oxides such as aluminum oxide, calcium oxide, strontium oxide, barium oxide, silicon oxide and the like and composites thereof, high resistance nitrides such as silicon nitride, aluminum nitride, boron nitride, tantalum nitride and the like and composites of these oxides and nitrides, and thin film materials, for example, semiconductors comprising amorphous silicon, amorphous selenium and the like which have low resistance as bulk, but may be made to have high resistance by a sputtering method, a CVD method, a vapor deposition method, a gas phase reaction method, a liquid coating method or the like.

As materials used for forming the second protective layer 116, in addition to Ta as mentioned above, there may be mentioned the elements of Group IIIa of the Periodic Table such as Sc, Y and the like, the elements of Group IVa such as Ti, Zr, Hf and the like, the elements of Group Va such as V, Nb and the like, the elements of the Group VIa such as Cr, Mo, W and the like, the elements of Group VIII such as Fe, Co, Ni and the like, alloys of the above-mentioned metals such as Ti—Ni, Ta—W, Ta—Mo—Ni, Ni—Cr, Fe—Co, Ti—W, Fe—Ti, Fe—Ni, Fe—Cr, Fe—Ni—Cr and the like, borides of the above-mentioned metals such as Ti—B, Ta—B, Hf—B, W—B and the like, carbides of the above-mentioned metals such as Ti—C, Zr—C, V—C, Ta—C, Mo—C, Ni—C, Cr—C and the like, silicides of the above-mentioned metals such as Mo—Si, W—Si, Ta—Si and the like, nitrides of the above-mentioned metals such as Ti—N, Nb—N, Ta—N and the like. Using these materials, the second protective layer may be formed by the procedure such as a .vapor deposition method, a sputtering method, a CVD method and the like. The second protective layer may be composed of the above materials, alone or in combination.

The third protective layer is composed of an organic insulating material which is excellent in prevention of liquid penetration and liquid resistance, and further has preferably the following characteristics:

(1) Good film shapeability, (2) Dense structure and free from pinholes, (3) Not swollen or dissolved in the ink, (4) High insulating property when film-shaped, (5) High heat resistance, and the like.

As the organic materials, there may also be used, for example, silicone resin, fluorine resin, aromatic polyamide, addition polymerization type polyimide, polybenzimidazole, metal chelate polymer, titanic acid ester, epoxy resin, phthalic resin, thermosetting phenolic resin, P-vinylphenolic resin, Zirox resin, triazine resin, BT resin (addition polymerized resin of triazine resin and bismaleimide) or the like. Alternatively, it is also possible to form the third protective layer by vapor deposition of polyxylylene resin and derivatives thereof.

Further, the third protective layer may also be formed by film shaping according to a plasma polymerization using various organic monomers such as thiourea, thioacetamide, vinyl ferrocene, 1,3,5-trichlorobenzene, chlorobenzene, styrene, ferrocene, pyroline, naphthalene, pentamethylbenzene, nitrotoluene, acrylonitrile, diphenyl selenide, p-toluidine, p-xylene, N,N-dimethyl-p-toluidine, toluene, aniline, diphenyl mercury, hexamethylbenzene, malononitrile, tetracyanoethylene, thiophene, benzeneselenol, tetrafluoroethylene, ethylene, N-nitrosodiphenylamine, acetylene, 1,2,4-trichlorobenzene, propane and the like.

However, when a recording head of a high density multi-orifice type is manufactured, apart from the above-mentioned organic materials, it is desirable to use organic materials capable of being very easily processed by a fine photolithography as materials for forming the third protective layer.

As examples of the organic materials, there may be preferably used, for example, polyimidoisoindoloquinazolinedione (trade name; PIQ, produced by Hitachi Kasei Co., Japan), polyimide resin (trade name: PYRALIN, produced by Du Pont, U.S.A. ), cyclized polybutadiene (trade name: JSR-CBR, CBR-M901, Japan Synthetic Rubber Co., Japan), Photonith (trade name: produced by Toray Co., Japan), other photosensitive polyimide and the like.

The support 115 is composed of silicon, glass, ceramics or the like.

Lower layer 109 is provided so as to control mainly the transfer of heat generated at heat generating portion 107 to support 115. The construction material is selected and the layer thickness is designed in such a way that the heat generated at heat generating portion 107 flows more to the heat actuating portion 106 side than to other portions when heat energy is applied to the liquid at heat actuating portion 106 while the heat remaining at heat generating portion 107 flows rapidly to the support 115 side when the electric current to electrothermal transducer 101 is switched off.

As the material for constituting lower layer 109, there may be used inorganic materials represented by metal oxides such as $SiO_2$, zirconium oxide, tantalum oxide, magnesium oxide and the like.

As the material constituting resistive heater layer 110, there may be used most materials capable of generating heat as desired by flowing electric current.

As examples of the materials, there may be preferably used, for example, tantalum nitride, nichrome, silver-palladium alloy, silicon semiconductor, or a metal such as hafnium, lanthanum, zirconium, titanium, tantalum, tungsten, molybdenum, niobium, chromium, vanadium and the like, alloys thereof, borides thereof or the like.

Among the materials constituting the resistive heater layer 110, metal borides are especially excellent. Of these, hafnium boride is the best, and next to this compound there are zirconium boride, lanthanum boride, tantalum boride, vanadium boride and niobium boride with better characteristic in the order as mentioned.

Using the above-mentioned material, the resistive heater layer 110 may be formed by the procedure such as an electron beam method, a sputtering method and the like.

As the materials for constituting electrodes 113 and 114, there may be effectively used most of conventional electrode materials, and there are mentioned, for example, Al, Ag, Au, Pt, Cu and the like. The electrodes may be formed at a predetermined position with a predetermined size, shape and thickness by means of vapor deposition or the like.

The electrodes may be provided on or under the resistive heater layer though the electrodes are formed on the resistive heater layer in the Figures.

As the materials for constituting the grooved plate 103 and the common liquid chamber provided at the upstream portion of heat actuating portion 106, there may be used most of the materials satisfying the following conditions: i) the shape is hardly or not at all thermally affected during fabrication of the recording head or during use of the recording head; ii) a fine precise processing can be applied thereto and the surface accuracy can be easily obtained as desired; and iii) the resulting liquid paths can be processed to permit the liquid to flow smoothly in the paths.

Representative materials for the above-mentioned purpose are preferably ceramics, glass, metals, plastics, silicon wafer and the like, and in particular, glass and silicon wafer are more preferable since they are easily processed, and have an appropriate degree of heat resistance, coefficient of thermal expansion and thermal conductivity. It is desired to apply to the outer surface of the circumference of orifice 104 a water repellent treatment where the liquid is aqueous and an oil repellent treatment where the liquid is non-aqueous, so as to prevent the liquid from leaking and flowing to the outside portion of orifice 104.

The order of overlapping of a third protective layer and a second protective layer is not critical, and any one of the layers may overlap the other as far as the overlapping width is within the above-mentioned range. It is not necessary that the overlapping width is the same at all portions in the vicinity of the electrothermal transducers, but the overlapping width may be different from portion to portion as far as it is within the above-mentioned range.

Figure 4A:
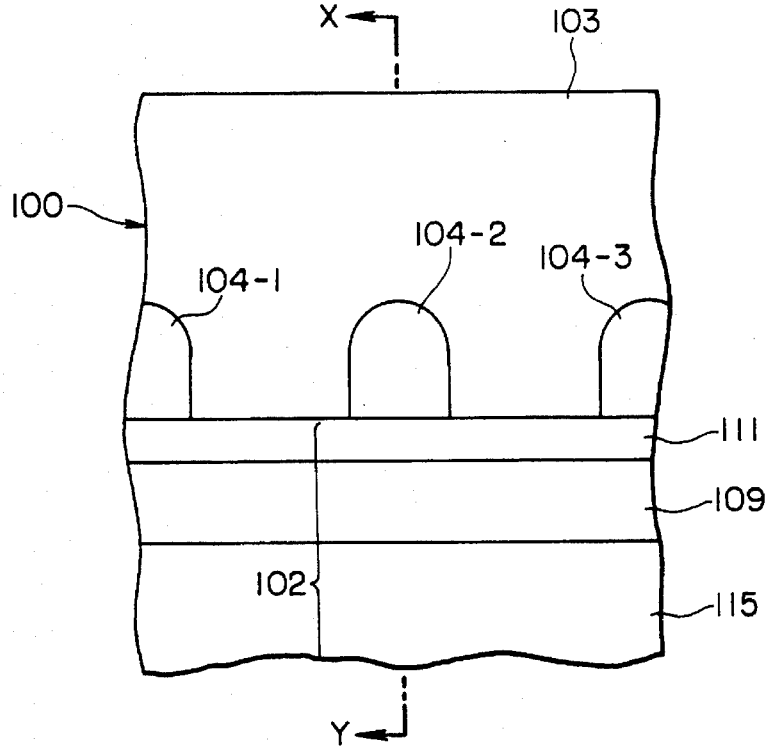
FIG. 4A PRIOR ART
FIG. 4A, B and C refer to the constitution of a conventional liquid jet recording head.
Figure 4B:
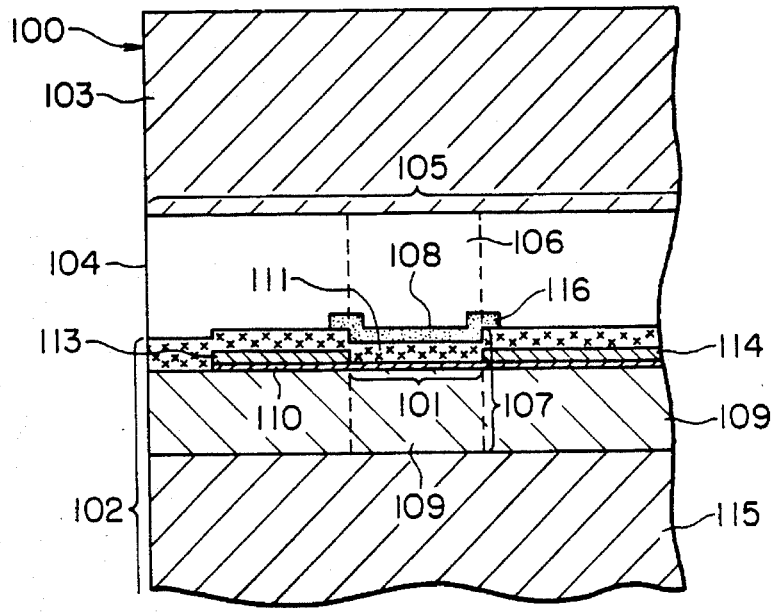
FIG. 4B PRIOR ART
FIG. 4B is the partial cross-sectional view taken along a dot and dash line XY in FIG. 4A.
Figure 4C:
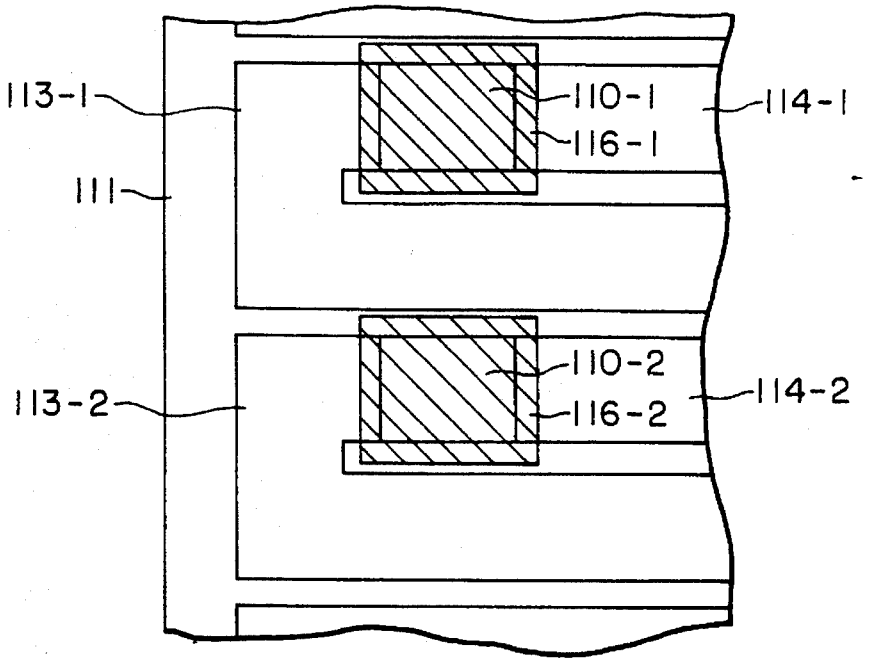
FIG. 4C PRIOR ART
FIG. 4C shows schematically a plan view of the substrate.
Figure 5:
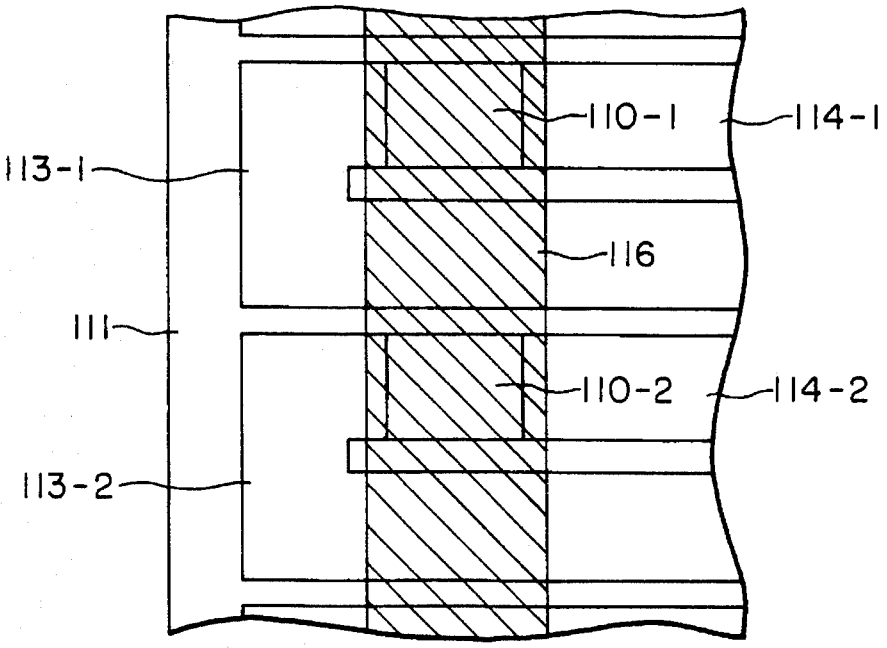
FIG. 5 refers to the constitution of an embodiment of the liquid jet recording head according to the present invention and shows schematically the plan view of the substrate equivalent to FIG. 4C.

FIG. 5 shows another preferred embodiment of the liquid jet recording head according to the present invention corresponding to FIG. 4C.

In FIG. 5, according to the present invention, the second protective layer is not provided individually on each heat generating portion, but continuously covers adjacent heat generating portions, that is, the second protective layer is in a form of a bar or strip.

Protective layers in the upper layer have mainly a function isolating a resistive heater layer from liquid in a liquid flow path and a function of cavitation resistance, as mentioned above. In the embodiment of FIG. 5, the first protective layer has mainly the former function while the second protective layer has mainly the latter function. Where the second protective layer is formed in the shape as shown in FIG. 5, the patterning is easy. Therefore, nozzles arranged at a high density can be fabricated without any complicated and highly precise processing. When this shape is employed, the probability of shorts at the electrodes, resistive heaters and the first protective layers becomes about twice that in the case of the prior art as shown in FIGS. 4A, 4B and 4C, but since the density of pinhole which caused short is about $1\text{–}5\times10^{-3}$ pinholes per $cm^2$, the probability of short is 0.02–0.1% even for a liquid jet recording head with a density as high as 1000 nozzles, and thereby a sufficiently high manufacturing yield can be ensured. Judging collectively this type of arrangement of the second protective layer taking into consideration the easy fabrication, high yield and the like, the above-mentioned liquid jet recording head is finally better in points of density and image quality than that of prior art.

In the embodiment shown in FIG. 5, electrodes 113 and 114 below the liquid flow path are covered almost only by a first protective layer 111. A third protective layer composed of an organic material having an excellent coating property may be formed above the first protective layer except the portion corresponding to the heat actuating surface.

The following examples are given for illustrating the present invention, but not for limitation thereof.

EXAMPLE 1

A liquid jet recording head according to the present invention was manufactured as shown below.

An $SiO_2$ film of 5 μm thick was formed by thermally oxidizing an Si wafer, and on the $SiO_2$ film, a 3,000-Å thick resistive heater layer composed of $HfB_2$ was formed by a sputtering. Then, by an electron beam deposition, a Ti layer of 50Å thick and an Al layer of 10,000Å thick were continuously deposited.

The pattern of electrodes 113 and 114 was formed by a photolithographic step. Size of a heat actuating surface was 50 μm in width and 150 μm in length.

A 2.8-μm thick first protective layer 111 composed of $SiO_2$ was deposited by a high rate sputtering.

Next, a second protective layer 116 was formed as follows. A 0.5-μm thick polyimide resin as a resist for a Ta lift-off was formed except for a circumference of a cut part (400×300 μm) and then, a Ta film of 0.5 μm thick was formed by a magnetron sputtering. After forming the Ta film, a lift-off patterning was performed so as to leave the Ta film on the cut part by removing polyimide resin using a liquid release agent.

Photonith (produced by Toray Co. , Japan) was applied by a spinner coating and a patterning development was performed so as to make the cut part (300×200 μm) in the circumference of the heat actuating surface. Thereby, a third protective layer 112 was produced. The overlapping width of the third protective layer and the second protective layer was 50 μm. Further, a substrate for the liquid jet recording head was produced by baking.

A pulse-shaped signal having 23V, 10 μs in pulse width and 800 Hz in repetition frequency was applied to the resulting electrothermal transducer of the recording head. According to the applied signal, a liquid was jetted as droplets, and flying droplets were formed stably.

To clarify the relation between the percent defective of the recording head and the overlapping width, Pt electrode was introduced into an ink liquid such that an ink potential became GND and +40 V was applied to the recording head. The percent defective was investigated after allowing to stand for 200 hr while maintaining the ink liquid temperature at 80° C.

Figure 2:
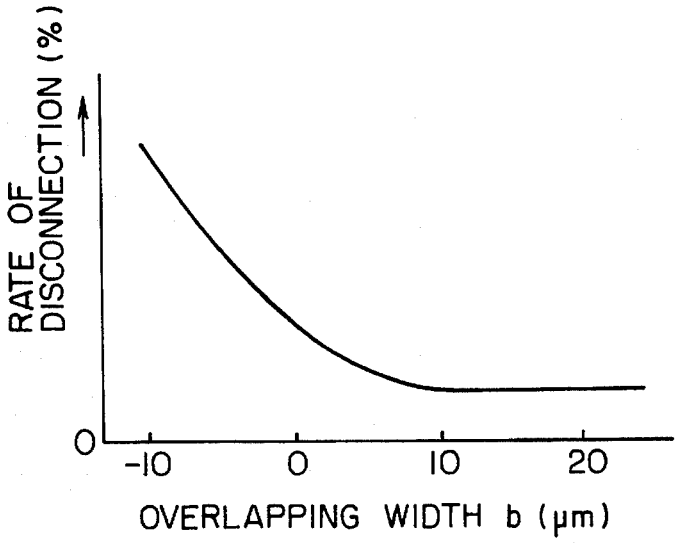
FIG. 2 is a graph showing the relationship between the overlapping width b of a second protective layer and a third protective layer and a rate of disconnection.

FIG. 2 shows the result of examining the rate of disconnection due to dissolution of electrode occurring where the overlapping width b was from minus to about zero as shown in FIG. 1B. When the overlapping b was minus (no overlapping), the electrode was dissolved from a defective part of a inorganic insulating layer (defective step coverage, a pinhole part) and as a result, the disconnection occurred.

When the overlapping b was less than about 10 μm, the disconnection occurred as the result of infiltration of the liquid into a boundary part overlapped.

Figure 3A:
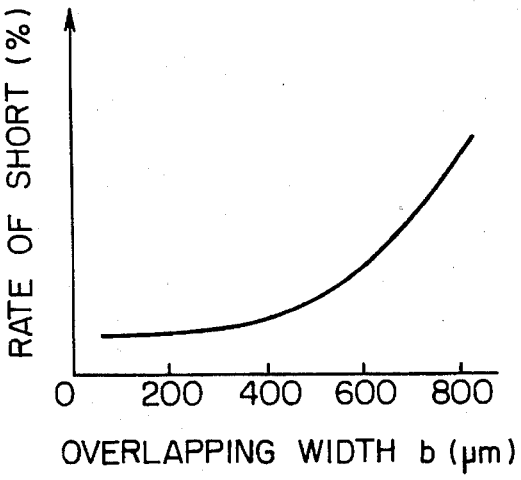
FIG. 3A is a graph which shows the relationship between the overlapping width b and the rate of short, in the liquid jet recording head where a third protective layer overlaps a second.

When the overlapping width was plus (overlapping) as shown in FIG. 1C, D, E, F, G and H and when the second protective layer composed of an inorganic material was underlaid the third protective layer as shown in FIG. 1C, E and G, especially having the large overlapping region as shown in FIG. 1E, there was caused a problem of a short circuit between the second protective layer and the electrode (the defective part of the inorganic insulating layer). In particular, as shown in FIG. 3A, when b in such heads was 500 μm or more, a yield decreased extremely, and further, when a heat potential infiltration test was carried out in the above-mentioned ink, a stable jet was fabricated by oxidation of the surface of the inorganic layer.

Figure 3B:
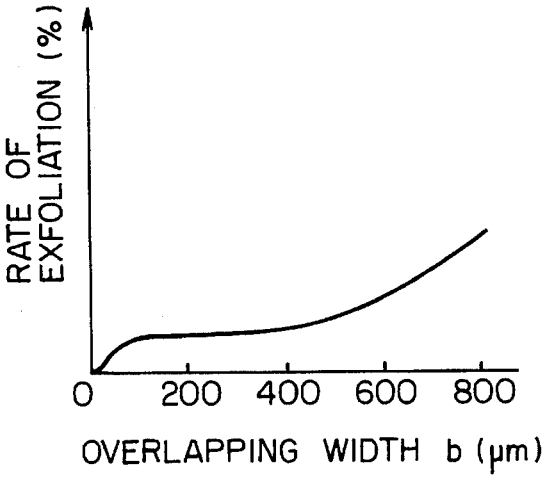
FIG. 3B is a graph which shows the relationship between the overlapping width b and the rate of film exfoliation, in the liquid jet recording head where a second protective layer overlaps a third protective layer.

When the second protective layer is overlaid on the third protective layer composed of an organic material as shown in FIG. 1D, F and H, a film exfoliation, as shown in FIG. 3B, is caused in such heads by a stress of the second protective layer (i.e., the upper inorganic layer), a swelling of the third protective layer (i.e., the lower organic layer), a stress by a difference in a thermal expansion coefficient between the both layers and the like. The film exfoliation is caused by a step of the organic layer and the defection of the inorganic layer. Therefore, in case of the small overlapping width, the film exfoliation occurs to some extent, and especially, in the case of the overlapping width of 500 μm or more, a whole exfoliation occurs from a tip portion of the inorganic layer. These problems are serious.

Therefore, where an overlapping width of 10–500 μm is used, a liquid jet recording head excellent in reliability and ink-resistance and capable of being produced in good yield can be obtained.

EXAMPLE 2

A liquid jet recording head as shown in FIG. 5 was manufactured as shown below.

An $SiO_2$ film of 5 μm thick was formed by thermally oxidizing an Si wafer, and on the $SiO_2$ film, a 1500-Å thick resistive heater layer composed of $HfB_2$ was formed by sputtering. Then, by an electron beam deposition, a Ti layer of 50Å thick and an Al layer of 5,000Å were successively deposited.

The pattern of electrodes 113 and 114 as shown in FIG. 5 was formed by photolithographic steps. Size of a heat actuating surface was 30 μm in width and 150 μm in length. The resistance was 150 ohm, including the resistance of Al electrode.

A 2.5-μm thick first protective layer 111 composed of $SiO_2$ was deposited by a high rate sputtering.

Next, a second protective layer 116 was formed according to the following process. A 3-μm thick polyimide film (trade name: PIQ, produced by Hitachi Kasei Co., Japan) as a resist for a Ta lift-off was formed by patterning and thereafter, a Ta film of 10 μm thick was formed by DC sputtering. The PIQ film was exfoliated after forming the Ta film to obtain a desired pattern of Ta film. Thus, a substrate with the strip shown in FIG. 5 was fabricated.

Degree of the short between the resistive heater member and the electrode and a second protective layer Ta in the resulting substrate was investigated for 123 substrates, each substrate having 100 segments, and none of them showed the resistance of 10 Mψ or less.

Finally, a grooved glass plate for constituting liquid flow paths, heat actuating portions and orifices was adhered to a predetermined place such that the groove portions were disposed fitly on heat generating portions formed on the substrate.

A liquid jet experiment was carried out by applying a pulse-shaped signal having 30 V, 10 μS in pulse width and 800 Hz in repetition frequency to the resulting electrothermal transducer of the recording head, As a result, a reliability equal to or higher than the prior art was obtained.

Recording heads having 8 nozzles/mm, 12 nozzles/mm and 16 nozzles/mm in nozzle density were similarly manufactured. In this case, the yield by the Ta film patterning was compared with the prior art as shown in Table 1.

TABLE 1

| nozzle density | Prior art | Present invention |
|---|---|---|
| 8 nozzles/mm | 90% | 98% |
| 12 nozzles/mm | 68% | 97.5% |
| 16 nozzles/mm | 45% | 96.0% |

According to the present invention as described above, there can be provided a liquid jet recording head having high quality and high density which can be manufactured in a high yield.

What is claimed is:

1. A liquid jet recording head comprising:

a substrate comprising
- a support,
- a resistive heater layer, and
- electrodes electrically connected with the resistive heater layer, wherein a portion of the resistive heater layer located between the electrodes forms an electrothermal transducer;

an upper layer comprising
- a first protective layer comprising an inorganic insulating material,
- a second protective layer comprising an inorganic material, and
- a third protective layer comprising an organic material; and
- a liquid flow path on the substrate corresponding to the electrothermal transducer;

wherein the upper layer includes
- a region where the first protective layer overlies the electrothermal transducer and the second protective layer overlies said first protective layer, and
- another region, in the vicinity of the electrothermal transducer, where the first protective layer overlies portions of the electrodes corresponding to the liquid flow path and where the third protective layer overlies the first protective layer, wherein the second protective layer extends from the electrothermal transducer into the other region and the second protective layer and the third protective layer overlap in the other region with the overlapping width of the second protective layer and the third protective layer being in the range from 10 μm to 500 μm.

2. A liquid jet recording head according to claim 1 in which the first protective layer is composed of a material selected from inorganic oxides, transition metal oxides, metal oxides, and composites thereof.

3. A liquid jet recording head according to claim 1 in which the first protective layer is composed of a high resistance nitride.

4. A liquid jet recording head according to claim 1 in which the first protective layer is composed of a composite of two or more of inorganic oxides, transition metal oxides, metal oxides and high resistance nitrides.

5. A liquid jet recording head according to claim 1 in which the first protective layer is composed of a thin film material.

6. A liquid jet recording head according to claim in which the second protective layer contains an element selected from Groups IIIa, IVa, Va, VIa and VIII of the Periodic Table and alloys thereof.

7. A liquid jet recording head according to claim 1 in which the second protective layer is composed of a material selected from carbides, silicides and nitrides of metals of Groups IIIa, IVa, Va, VIa and VIII of the Periodic Table.

8. A liquid jet recording head according to claim 1 in which the third protective layer is composed of a resin.

9. A liquid jet recording head according to claim 1 in which the third protective layer is fabricated by microphotolithography.

10. A liquid jet recording head according to claim 1 in which the third protective layer is fabricated by using a photosensitive polyimide resin.

11. A liquid jet recording head according to claim 1 in which there are a plurality of liquid flow paths.

12. A liquid jet recording head according to claim 1 further comprising a plurality of the heat generating portions and liquid flow paths wherein the second protective layer extends in a direction along the liquid flow paths for substantially less than the length thereof in a continuous strip covering adjacent heat generating portions.

13. A liquid jet recording head comprising:

a substrate comprising
- a support,
- a resistive heater layer, and
- electrodes electrically connected with the resistive heater layer, wherein a portion of the resistive heater layer located between the electrodes forms an electrothermal transducer; and an upper layer comprising
- a first protective layer comprising an inorganic insulating material,
- a second protective layer comprising an inorganic material, and
- a third protective layer comprising an organic material;

wherein the upper layer includes
- a region where the first protective layer overlies the electrothermal transducer and the second protective layer overlies the first protective layer, and
- another region, in the vicinity of the electrothermal transducer, where the first protective layer overlies portions of the electrodes corresponding to a liquid flow path .forming portion of the substrate that corresponds to the electrothermal transducer and where the third protective layer overlies the first protective layer, wherein the second protective layer extends from the electrothermal transducer into the other region and the second protective layer and the third protective layer overlap in the other region with the overlapping width of the second protective layer and the third protective layer being in the range from 10 μm to 500 μm.

14. A liquid jet recording head according to claim 13 in which the first protective layer is composed of a material selected from inorganic oxides, transition metal oxides, metal oxides, and composites thereof.

15. A liquid jet recording head according to claim 13 in which the first protective layer is composed of a high resistance nitride.

16. A liquid jet recording head according to claim 13 in which the first protective layer is composed of a composite of two or more of inorganic oxides, transition metal oxides, metal oxides and high resistance nitrides.

17. A liquid jet recording head according to claim 13 in which the first protective layer is composed of a thin film material.

18. A liquid jet recording head according to claim 13 in which the second protective layer contains an element selected from Groups IIIa, IVa, Va, VIa and VIII of the Periodic Table and alloys thereof.

19. A liquid jet recording head according to claim 13 in which the second protective layer is composed of a material selected from carbides, silicides and nitrides of metals of Groups IIIa, IVa, Va, VIa, and VIII of the Periodic Table.

20. A liquid jet recording head according to claim 13 in which the third protective layer is composed of a resin.

21. A liquid jet recording head according to claim 13 in which the third protective layer is fabricated by micro-photolithography.

22. A liquid jet recording head according to claim 13 in which the third protective layer is fabricated by using a photosensitive polyimide resin.

23. A liquid jet recording head according to claim 13 in which a plurality of liquid flow path portions are provided.

24. A liquid jet recording head according to claim 13, further comprising a plurality of the heat generating portions and liquid flow path portions, wherein the second protective layer extends in a direction along the liquid flow path portions for substantially less than the length thereof in a continuous strip covering adjacent heat generating portions.

25. A liquid jet recording apparatus comprising:

a liquid jet recording head comprising
- a substrate comprising;
  - a support,
  - a resistive heater layer, and
  - electrodes electrically connected with the resistive heater layer, wherein a portion of the resistive heater layer located between the electrodes forms an electrothermal transducer;
- an upper layer comprising:
  - a first protective layer comprising an inorganic insulating material,
  - a second protective layer comprising an inorganic material, and
  - a third protective layer comprising an organic material;
- a liquid flow path on the substrate corresponding to the electrothermal transducer;
- wherein the upper layer includes
  - a region where the first protective layer overlies the electrothermal transducer and the second protective layer overlies the first protective layer, and
  - another region, in the vicinity of the electrothermal transducer, where the first protective layer overlies portions of the electrodes corresponding to the liquid flow path and where the third protective layer overlies the first protective layer, wherein the second protective layer extends from the electrothermal transducer into the other region and the second protective layer and the third protective layer overlap in the other region with the overlapping width of the second protective layer and the third protective layer being in the range from 10 μm to 500 μm; and means for supplying a signal to the electrothermal transducer.

26. A liquid jet recording head comprising:

a substrate comprising
- a support,
- a resistive heater layer, and
- electrodes electrically connected with the resistive heater layer, wherein a portion of the resistive heater layer located between the electrodes forms a plurality of adjacent electrothermal transducers;

an upper layer comprising
- a first protective layer comprising an inorganic insulating material, and
- a second protective layer comprising an inorganic material; and a plurality of liquid flow paths on the substrate corresponding to the electrothermal transducers;

wherein the first protective layer and the second protective layer are successively formed at least on the electrothermal transducers and the second protective layer extends in a direction along the liquid flow paths for substantially less than the length thereof in a continuous strip that covers the adjacent electrothermal transducers.

27. A liquid jet recording head according to claim 26 in which a third protective layer is further provided on the first protective layer.

28. A liquid jet recording head according to claim 27 in which the third protective layer is composed of a resin.

29. A liquid jet recording head according to claim 27 in which the third protective layer is fabricated by micro-photolithography.

30. A liquid jet recording head according to claim 27 in which the third protective layer is fabricated by using a photosensitive polyimide resin.

31. A liquid jet recording head according to claim 26 in which the first protective layer is composed of material selected from inorganic oxides, transition metal oxides, metal oxides, and composites thereof.

32. A liquid jet recording head according to claim 26 in which the first protective layer is composed of a high resistance nitride.

33. A liquid jet recording head according to claim 26 in which the first protective layer is composed of a composite of two or more of inorganic oxides, transition metal oxides, metal oxides and high resistance nitrides.

34. A liquid jet recording head according to claim 26 in which the first protective layer is composed of a thin film material.

35. A liquid jet recording head according to claim 26 in which the second protective layer contains an element selected from Groups IIIa, IVa, Va, VIa and VIII of the Periodic Table and alloys thereof.

36. A liquid jet recording head according to claim in which the second protective layer is composed of a material selected from carbides, silicides and nitrides of metals of Groups IIIa, IVa, Va, VIa and VIII of the Periodic Table.

37. A liquid jet recording head comprising:

a substrate comprising;
- a support,
- a resistive heater layer, and
- electrodes electrically connected with the resistive heater layer, wherein a portion of the resistive heater layer located between the electrodes forms a plurality of adjacent electrothermal transducers; and an upper layer comprising
- a first protective layer comprising an inorganic insulating material, and
- a second protective layer comprising an inorganic material;

wherein the first protective layer and the second protective layer are successively formed at least on the electrothermal transducers and the second protective layer extends in a direction along a plurality of liquid flow path forming portions of the substrate that correspond to the electrothermal transducers for substantially less than the length thereof in a continuous strip that covers the adjacent electrothermal transducers.

38. A liquid jet recording head according to claim 37 in which a third protective layer is further provided on the first protective layer.

39. A liquid jet recording head according to claim 38 in which the third protective layer is composed of a resin.

40. A liquid jet recording head according to claim 38 in which the third protective layer is fabricated by microphotolithography.

41. A liquid jet recording head according to claim 38 in which the third protective layer is fabricated by using a photosensitive polyimide resin.

42. A liquid jet recording head according to claim 37 in which the first protective layer is composed of material selected from inorganic oxides, transition metal oxides, metal oxides, and composites thereof.

43. A liquid jet recording head according to claim 37 in which the first protective layer is composed of a high resistance nitride.

44. A liquid jet recording head according to claim 37 in which the first protective layer is composed of a composite of two or more of inorganic oxides, transition metal oxides, metal oxides and high resistance nitrides.

45. A liquid let recording head according to claim 37 in which the first protective layer is composed of a thin film material.

46. A liquid jet recording head according to claim 37 in which the second protective layer contains an element selected from Groups IIIa, IVa, Va, VIa and VIII of the Periodic Table and alloys thereof.

47. A liquid Jet recording head according to claim 37 in which the second protective layer is composed of a material selected from carbides, silicides and nitrides of metals of Groups IIIa, IVa, Va, VIa and VIII of the Periodic Table.

48. A liquid jet recording apparatus comprising:

a liquid jet recording head comprising
- a substrate comprising
  - a support,
  - a resistive heater layer, and
  - electrodes electrically connected with the resistive heater layer, wherein a portion of the resistive heater layer located between the electrodes forms a plurality of adjacent electrothermal transducers;
- an upper layer comprising
  - a first protective layer comprising an inorganic insulating material, and
  - a second protective layer comprising an inorganic material;
- a plurality of liquid flow paths on the substrate corresponding to the electrothermal transducers,
- wherein the first protective layer and the second protective layer are successively formed at least on the electrothermal transducers and the second protective layer extends in a direction along the liquid flow paths for substantially less than the length thereof in a continuous strip that covers the adjacent electrothermal transducers; and means for supplying signals to the electrothermal transducers.

* * * * *

UNITED STATES PATENT AND TRADEMARK OFFICE

CERTIFICATE OF CORRECTION

PATENT NO. : 5,455,612

DATED : October 3, 1995

INVENTOR(S) : Masami Ikeda et al.

It is certified that error appears in the above-identified patent and that said Letters Patent is hereby corrected as shown below:

COLUMN 1

Line 42, "to" should be deleted
Line 61, "cross sectional" should read --cross-sectional--.

COLUMN 3

Line 35, "insulting" should read --insulating--
Line 36, "above" should read --upper--.

COLUMN 4

Line 22, "quality" should read --quality and--
Line 23, "and" should be deleted.

COLUMN 8

Line 50, "short" should read --shorts--
Line 51, "short" should read --shorts--.

UNITED STATES PATENT AND TRADEMARK OFFICE

CERTIFICATE OF CORRECTION

PATENT NO. : 5,455,612

DATED : October 3, 1995

INVENTOR(S) : Masami Ikeda et al.

It is certified that error appears in the above-identified patent and that said Letters Patent is hereby corrected as shown below:

COLUMN 10

Line 9, "defection of" should read --defect in--
Line 52, "10 Mψ" should read --10 MΩ--
Line 61, "head,As" should read --head. As--.

COLUMN 11

Line 34, "said" should read --the--
Line 60, "claim" should read --claim 1--.

COLUMN 12

Line 12, "paths" should read --paths,--
Line 38, ".forming" should read --forming--.

COLUMN 13

Line 20, "comprising;" should read --comprising--.

COLUMN 14

Line 38, "claim" should read --claim 26--.

UNITED STATES PATENT AND TRADEMARK OFFICE

CERTIFICATE OF CORRECTION

PATENT NO. : 5,455,612

DATED : October 3, 1995

INVENTOR(S) : Masami Ikeda et al.

It is certified that error appears in the above-identified patent and that said Letters Patent is hereby corrected as shown below:

COLUMN 15

Line 19, "let" should read --jet--
Line 26, "Jet" should read jet--.

Signed and Sealed this

Ninth Day of April, 1996

Bruce Lehman

*Attest:*

BRUCE LEHMAN

*Attesting Officer*

*Commissioner of Patents and Trademarks*